US009772575B1

(12) United States Patent
Yamaura et al.

(10) Patent No.: US 9,772,575 B1
(45) Date of Patent: Sep. 26, 2017

(54) IMAGE FORMING APPARATUS AND METHOD, AND NON-TRANSITORY COMPUTER READABLE MEDIUM

(71) Applicant: FUJI XEROX CO., LTD., Tokyo (JP)

(72) Inventors: Masaaki Yamaura, Kanagawa (JP); Satoshi Shigezaki, Kanagawa (JP); Yoshiki Shimodaira, Kanagawa (JP); Yoshiyuki Tominaga, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/225,878

(22) Filed: Aug. 2, 2016

(30) Foreign Application Priority Data

Mar. 23, 2016 (JP) ..... 2016-059148

(51) Int. Cl.
*G03G 15/01* (2006.01)
*G03G 15/16* (2006.01)

(52) U.S. Cl.
CPC ..... *G03G 15/0131* (2013.01); *G03G 15/1605* (2013.01)

(58) Field of Classification Search
None
See application file for complete search history.

(56) References Cited

U.S. PATENT DOCUMENTS

2011/0103811 A1 5/2011 Tamaki
2011/0236045 A1* 9/2011 Tanaka ..... G03G 15/50 399/45
2013/0251431 A1* 9/2013 Numao ..... G03G 15/6585 399/341
2014/0255053 A1 9/2014 Ohshika
2014/0369723 A1* 12/2014 Takahashi ..... G03G 15/2014 399/321
2015/0185678 A1* 7/2015 Yoshida ..... G03G 15/6585 399/67
2016/0282776 A1* 9/2016 Kunimori ..... G03G 15/6585
2017/0090327 A1* 3/2017 Shimazu ..... G03G 15/1605

FOREIGN PATENT DOCUMENTS

JP 2006078883 A * 3/2006
JP 2006243209 A * 9/2006 ..... G03G 15/5062
JP 2010152209 A * 7/2010 ..... H04N 1/2307
JP 2011-99934 A 5/2011
JP 2014-197165 A 10/2014

* cited by examiner

*Primary Examiner* — Sevan A Aydin
(74) *Attorney, Agent, or Firm* — Sughrue Mion, PLLC

(57) ABSTRACT

An image forming apparatus includes multiple first image forming units, a second image forming unit, and a controller. The first image forming units transfer toner images developed with colored toners to a transfer body, and form first images on the transfer body. The second image forming unit transfers a toner image developed with a spot color toner different from colors of the colored toners to the transfer body prior to the first image forming units, and forms a second image serving as an undercoat or an overcoat of the first images on the transfer body. The controller controls the first image forming units in order that amounts of the colored toners used for forming the first images by the first image forming units become less than amounts of the colored toners used when the first images are formed prior to the second image.

10 Claims, 10 Drawing Sheets

FIG. 5

| COLOR | COLOR OF UNDERCOAT IN COLOR-FADED PART | COLOR DIFFERENCE | BRIGHTNESS DIFFERENCE |
|---|---|---|---|
| R | Y | 106.1 | 47.6 |
| G | Y | 113.8 | 50.4 |
| B | M | 78.9 | 30.0 |
| Bk | M | 85.3 | 29.2 |
| R (REVERSE ORDER) | M | 49.7 | 0.1 |

FIG. 7

| M/C NUMBER OF TONER LAYERS | Y NUMBER OF TONER LAYERS | CT NUMBER OF TONER LAYERS | TOTAL NUMBER OF TONER LAYERS | DEFECT LEVEL |
|---|---|---|---|---|
| 1 | 1 | 1.2 | 3.2 | 3 |
| 0.9 | 0.9 | 1.2 | 3 | 3 |
| 0.8 | 0.8 | 1.2 | 2.8 | 2 |
| 0.7 | 0.7 | 1.2 | 2.6 | 1 |

IMAGE FORMING APPARATUS AND METHOD, AND NON-TRANSITORY COMPUTER READABLE MEDIUM

CROSS-REFERENCE TO RELATED APPLICATIONS

This application is based on and claims priority under 35 USC 119 from Japanese Patent Application No. 2016-059148 filed Mar. 23, 2016.

BACKGROUND (i) Technical Field

The present invention relates to an image forming apparatus and method, and a non-transitory computer readable medium.

(ii) Related Art

In recent image forming apparatuses that form color images, a toner of a spot color such as white, gold, silver, or a transparent color is sometimes used in addition to conventionally-used colored toners of yellow (Y), magenta (M), cyan (C), and black (K).

Whereas the colored toners form an image specified by a user (user image), the spot color toner is mainly used to form the undercoat or overcoat of the user image or to form an image having a color that is difficult to realize with the colored toners.

The amount of toners used in forming an image increases in response to an increase in types of toners used by the image forming apparatus. When the amount of toners included in an image increases, for example discharge tends to occurs more easily when an image is transferred to a transfer body. This discharge may cause color unevenness in the image, for example, which may result in degradation of the image quality.

SUMMARY

According to an aspect of the invention, there is provided an image forming apparatus including multiple first image forming units, a second image forming unit, and a controller. The first image forming units transfer toner images developed with colored toners to a transfer body, and form first images on the transfer body. The second image forming unit transfers a toner image developed with a spot color toner different from colors of the colored toners to the transfer body prior to the first image forming units, and forms a second image serving as an undercoat or an overcoat of the first images on the transfer body. The controller controls the first image forming units in order that amounts of the colored toners used for forming the first images by the first image forming units become less than amounts of the colored toners used when the first images are formed prior to the second image.

BRIEF DESCRIPTION OF THE DRAWINGS

An exemplary embodiment of the present invention will be described in detail based on the following figures, wherein:

FIG. 5 is a diagram illustrating an example of a color difference and a brightness difference according to a combination of toner colors;

FIG. 7 is a diagram illustrating an exemplary relationship between the number of toner layers and the defect level;

DETAILED DESCRIPTION

Hereinafter, an exemplary embodiment of the present invention will be described in detail with reference to the drawings. Elements that perform actions or jobs with the same operations or functions are given the same symbols throughout the drawings, and overlapping descriptions are omitted.

Yellow is represented as Y, magenta as M, cyan as C, black as K, white as W, and a spot color as CT. When it is necessary to describe the individual members on a color-by-color basis, the members are differentiated by having color symbols (Y, M, C, K, W, and CT) corresponding to the individual colors at the end of the members' symbols. In contrast, when the members are collectively described without making distinctions, color symbols added at the end of the members' symbols are omitted.

Figure 1:
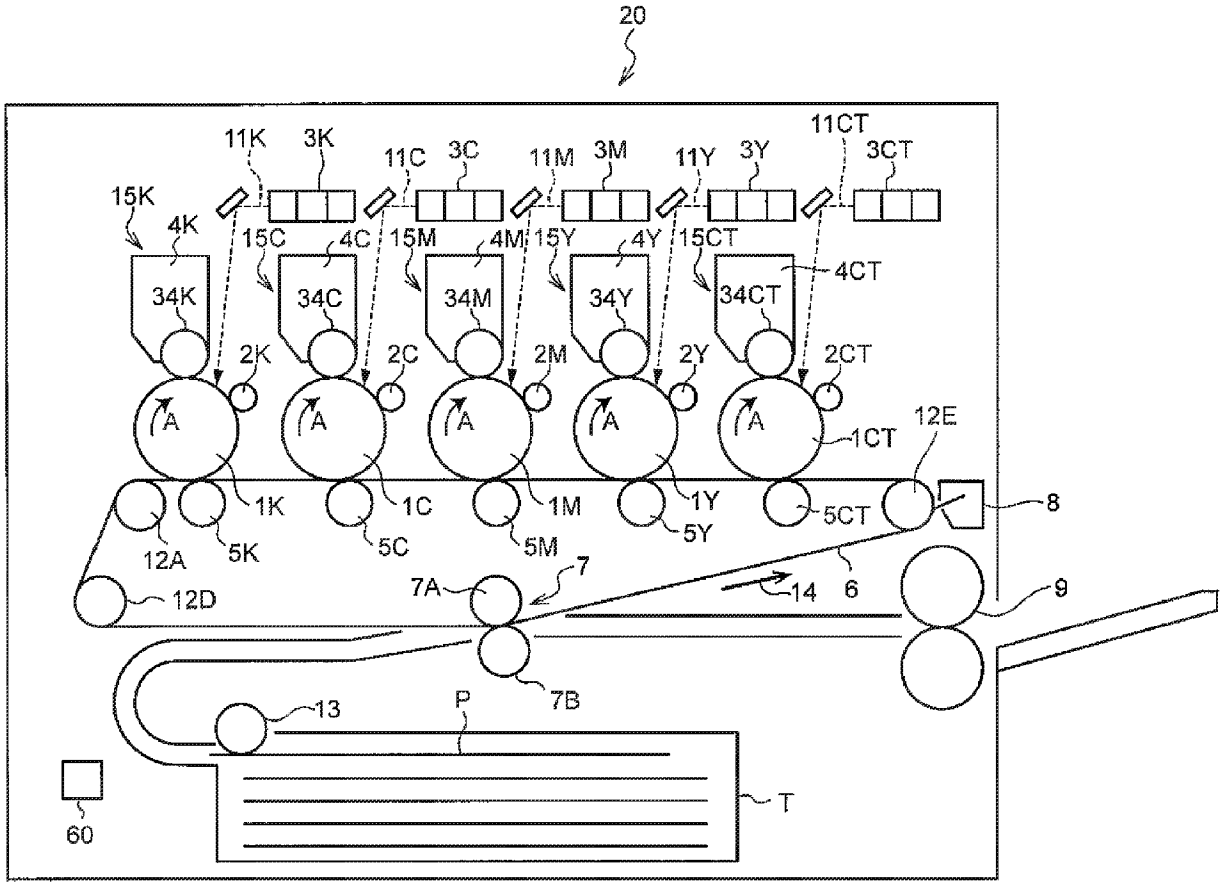
FIG. 1 is a schematic lateral view illustrating an exemplary configuration of an image forming apparatus.

FIG. 1 is a schematic lateral view illustrating an exemplary configuration of main portions of an image forming apparatus 20 using the electrophotographic system according to the exemplary embodiment. The image forming apparatus 20 has an image forming function that receives image data via a communication line (not illustrated), for example, and forms an image (user image) based on the received image data on a recording medium.

For Y, M, C, K, and CT, the image forming apparatus 20 includes five photoconductors 1Y, 1M, 1C, 1K, and 1CT, which rotate in the direction indicated by arrow A in FIG. 1, and chargers 2Y, 2M, 2C, 2K, and 2CT, which charge the surfaces of the photoconductors 1 by applying charge bias.

The image forming apparatus 20 includes laser output units 3Y, 3M, 3C, 3K, and 3CT, which expose the charged surfaces of the photoconductors 1 with exposure light modulated on the basis of image information of the individual colors, and form electrostatic latent images on the photoconductors 1, and developing rollers 34Y, 34M, 34C, 34K, and 34CT, which are examples of developer carriers that carry developers (toners) of the individual colors.

The image forming apparatus 20 further includes developers 4Y, 4M, 4C, 4K, and 4CT, which develop the electrostatic latent images on the photoconductors 1 with the individual colored toners by applying developing bias to the developing rollers 34Y, 34M, 34C, 34K, and 34CT with the use of a developing bias power supply (not illustrated) and form toner images on the photoconductors 1, and first transfer devices 5Y, 5M, 5C, 5K, and 5CT, which transfer the toner images on the photoconductors 1 to an intermediate transfer belt 6.

The image forming apparatus 20 further includes a film container T, which accommodates a transparent film P, such as an overhead projector (OHP) sheet used in an OHP, for example, a second transfer device 7, which transfers the toner images on the intermediate transfer belt 6 to the film P, a fixing unit 9, which fixes the toner images transferred to the film P to the film P, and a belt cleaner 8, which removes the toners remaining on the surface of the intermediate transfer belt 6 after the second transfer device 7 transfers the toner images to the film P.

The image forming apparatus 20 also includes a cleaner (not illustrated) that cleans up the surfaces of the photoconductors 1, and a static electricity remover (not illustrated) that removes the residual electric charge on the surfaces of the photoconductors 1.

Note that the photoconductors 1, the chargers 2, the laser output units 3, the developers 4 including the developing rollers 34, and the first transfer devices 5 for Y, M, C, K, and CT are examples of image forming units 15, which cooperate with one another to form toner images on the intermediate transfer belt 6.

Next, an image forming operation of the image forming apparatus 20 illustrated in FIG. 1 will be described.

At first, for example, a terminal apparatus such as a personal computer (not illustrated) outputs a user image, which is an image forming target, to the image forming apparatus 20 via a communication line (not illustrated).

On receipt of the user image, the image forming apparatus 20 applies charge bias to the chargers 2, which in turn negatively charge the surfaces of the photoconductors 1.

Meanwhile, the user image is input to a controller 60 of the image forming apparatus 20. The controller 60 decomposes the user image into pieces of image data of the YMCK colors, and outputs modulation signals based on the pieces of image data of the individual colors to the laser output units 3 of the corresponding colors. Meanwhile, the controller 60 outputs a modulation signal corresponding to the background of an area where the pieces of image data of the YMCK colors are formed, namely, the undercoat, to the laser output unit 3CT. The laser output units 3 output laser beams 11 modulated in accordance with the input modulation signals.

The modulated laser beams 11 are emitted to the surfaces of the respective photoconductors 1. When the surfaces of the photoconductors 1, which are charged negatively by the chargers 2, are irradiated with the respective laser beams 11, charge in portions irradiated with the laser beams 11 disappears, and electrostatic latent images corresponding to the pieces of image data of YMCK and CT are formed on the respective photoconductors 1.

Furthermore, the developers 4Y, 4M, 4C, 4K, and 4CT of the individual colors contain toners that are colored Y, M, C, K, and W, respectively, and that are charged negatively, and the developing rollers 34, which attach the toners to the surfaces of the photoconductors 1. Although the following description assumes that the developer 4CT contains a toner colored W, the toner contained in the developer 4CT is not limited to the toner colored W. For example, a gold, silver, or transparent color toner may be contained in the developer 4CT. A gold or silver toner is used for applications such as making the user image glossy, and a transparent color toner is used for applications such as coating the user image.

Therefore, when a transparent color toner is used as the spot color CT, the controller 60 outputs a modulation signal corresponding to an area covering the pieces of image data of the YMCK colors to the laser output unit 3CT. When a gold or silver toner is used as the spot color CT, the controller 60 outputs a modulation signal corresponding to an area of the pieces of image data of the YMCK colors, which are to be made glossy, to the laser output unit 3CT.

When the electrostatic latent images formed on the photoconductors 1 reach the developers 4, the developing bias power supply (not illustrated) applies developing bias to the developing rollers 34 in the developers 4. In response to this, the toners of the individual colors held on the circumferential surfaces of the developing rollers 34Y, 34M, 34C, 34K, and 34CT adhere to the electrostatic latent images on the photoconductors 1Y, 1M, 1C, 1K, and 1CT, respectively, thereby forming toner images corresponding to the colors represented by the pieces of image data on the photoconductors 1Y, 1M, 1C, and 1K. A toner image of the W color corresponding to the undercoat of the image data is formed on the photoconductor 1CT.

Furthermore, a motor (not illustrated) rotates rollers 12A, 12D, and 12E, and a backup roll 7A of the second transfer device 7, thereby conveying the intermediate transfer belt 6 in the direction indicated by arrow 14. This causes the intermediate transfer belt 6 to be pressed against the photoconductors 1 at first transfer nip parts formed by the first transfer devices 5 and the photoconductors 1. At this time, a first transfer bias power supply (not illustrated) applies first transfer bias to the first transfer devices 5, thereby transferring the toner images of the individual colors, formed on the photoconductors 1, to the intermediate transfer belt 6.

Since the image forming unit 15CT for W, the image forming unit 15Y for Y, the image forming unit 15M for M, the image forming unit 15C for C, and the image forming unit 15K for K are arranged from the upstream side to the downstream side in the conveyance direction of the intermediate transfer belt 6, the toner images are formed so as to be superimposed on one another on the intermediate transfer belt 6 in the order W, Y, M, C, and K.

From the photoconductors 1 from which the toner images have been transferred to the intermediate transfer belt 6, the remover (not illustrated) removes adhesions such as remaining toners adhering to the surfaces of the photoconductors 1, and the static electricity remover (not illustrated) removes the residual electric charge.

In contrast, the second transfer device 7 includes the backup roll 7A and a second transfer roll 7B, which stretch the intermediate transfer belt 6. The second transfer roll 7B contacts the intermediate transfer belt 6 and rotates in accordance with the conveyance of the intermediate transfer belt 6.

A motor (not illustrated) rotates a film conveying roller 13, thereby conveying the film P in the film container T to a second transfer nip part formed by a second transfer roll pair including the backup roll 7A and the second transfer roll 7B of the second transfer device 7.

At the second transfer nip part, when the film P is pressed against the intermediate transfer belt 6 while facing the side of the intermediate transfer belt 6 on which the toner images are formed, second transfer bias is applied to the second transfer roll pair, thereby transferring the toner images formed on the intermediate transfer belt 6 to the film P. The toner images transferred to the film P are heated under pressure by the fixing unit 9, and are fixed to the film P.

As has been described above, since the toner images are superimposed on one another in the order W, Y, M, C, and K, and are formed on the intermediate transfer belt 6, the toner images are transferred to the film P while being superimposed on one another in the opposite order from the order of stacking the toner images on the intermediate transfer belt 6, namely, in the order K, C, M, Y, and W.

Therefore, when the film P is viewed from the side opposite to the image forming side of the film P, the user image having the W toner as the undercoat is recognized.

From the intermediate transfer belt 6 from which the toner images have been transferred to the film P, the belt cleaner 8 removes adhesions, such as remaining toners adhering to the surface of the intermediate transfer belt 6.

Accordingly, the user image is formed on the film P, and the image forming operation ends. The configuration of the image forming apparatus 20 illustrated in FIG. 1 is only exemplary, and members such as the second transfer device 7 or the conveyance route of the film P may be arranged in any manner as long as the above-described image forming operation is executable.

Next, the first transfer bias of the first transfer devices 5 of the image forming apparatus 20, and the state of the toner images transferred to the intermediate transfer belt 6 will be described.

The operation of applying first transfer bias to the first transfer devices 5 and transferring the toner images on the photoconductors 1 to the intermediate transfer belt 6 will be referred to as "first transfer". When first transfer is performed, the electric field intensity of transfer bias applied to the first transfer nip parts, formed by the photoconductors 1 and the first transfer devices 5, may vary from one transfer to another, depending on variations in the shape or resistance value of members related to first transfer, such as the first transfer devices 5 and the photoconductors 1, or the amount of toners contained in the toner images formed on the intermediate transfer belt 6. When the electric field intensity of transfer bias varies from one transfer to another, the colors of the user image may become uneven.

Therefore, to prevent the electric field intensity of transfer bias from varying from one transfer to another, the image forming apparatus 20 executes first transfer while performing constant current control such that, when first transfer is performed, variations in current supplied from the first transfer bias power supply (not illustrated) will be within a predetermined range.

Like the image forming apparatus 20 according to the exemplary embodiment, in an image forming apparatus that uses a spot color toner in addition to YMCK colored toners that are generally used, the amount of toners of toner images transferred to the intermediate transfer belt 6 tends to increase, compared with an image forming apparatus that does not use a spot color toner. Therefore, in the image forming apparatus 20, the system resistance on a circuit to which first transfer bias is applied becomes higher than that in an image forming apparatus that does not use a spot color toner, and accordingly, voltage applied to the first transfer nip parts also becomes higher.

Figure 2:
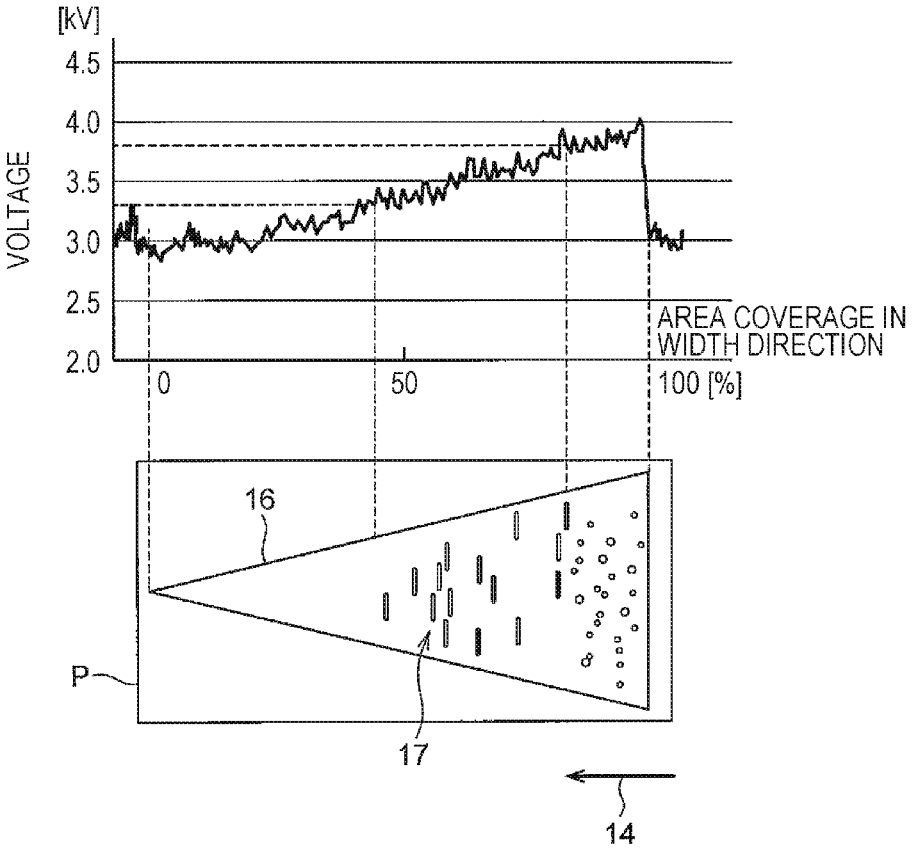
FIG. 2 is a diagram illustrating exemplary changes in a first transfer voltage with respect to area coverage.

FIG. 2 illustrates this case. That is, FIG. 2 illustrates changes in voltage applied to the first transfer nip parts when an evaluation toner image 16 which gradually widens in width direction of the intermediate transfer belt 6, which is a direction orthogonal to the conveyance direction of the intermediate transfer belt 6, is first-transferred to the intermediate transfer belt 6. In the graph of FIG. 2, the value of voltage applied to the first transfer nip parts is plotted in ordinate, and the area coverage of the evaluation toner image 16 in width direction of the intermediate transfer belt 6 is plotted in abscissa. The area coverage of the evaluation toner image 16 in width direction of the intermediate transfer belt 6 corresponds to the ratio of the toner image length of the evaluation toner image 16 in width direction of the intermediate transfer belt 6 with respect to the maximum toner image formation length in width direction of the intermediate transfer belt 6. For example, the evaluation toner image 16 is a red (hereinafter the red color will be represented as "R") toner image, which is formed by superimposing W, Y, and M toners in this order.

As illustrated in FIG. 2, the greater the area coverage becomes, that is, the greater the amount of toners used in the evaluation toner image 16 becomes, the higher the tendency becomes that the voltage applied to the first transfer nip parts becomes higher. Just before the area coverage becomes 50%, defects 17 in the form of streaks start to appear in the evaluation toner image 16. Furthermore, when the area coverage exceeds about 80%, the defects 17 in the form of dots start to appear in the evaluation toner image 16. Here, the term "defects 17" refers to image stains in general, such as faded colors and uneven colors of the image.

One of the causes of these defects 17 is conceivably, for example, the occurrence of a toner image retransfer phenomenon due to the influence of discharge on the toner images. The retransfer phenomenon refers to the phenomenon that the toner images transferred from the photoconductors 1 to the intermediate transfer belt 6 again adhere to the photoconductors 1.

When the voltage applied to the first transfer nip parts exceeds a certain voltage (about 3.3 kV in the example illustrated in FIG. 2), discharge over a relatively long cycle occurs at and around the first transfer nit parts. Accordingly, a voltage involved in the discharge is applied in the form of streaks. Furthermore, when the voltage applied to the first transfer nip parts rises and exceeds a certain voltage (about 3.8 kV in the example illustrated in FIG. 2), the cycle of charge/discharge gradually becomes shorter, and discharge over a relatively short cycle occurs at and around the first transfer nip parts. Accordingly, a voltage involved in the discharge is applied to the toner images in the form of dots.

Portions of the toner images where the voltage involved in the discharge is applied are charged positively relative to the other portions of the toner images. Since the toner images on the photoconductors 1 are transferred to the intermediate transfer belt 6 at the first transfer nip parts, the direction of the electric field at the first transfer nip parts is set to a direction in which the toner images on the photoconductors 1, which are negatively charged, become attracted to the intermediate transfer belt 6. Therefore, when the toner images are charged positively by discharge, at the first transfer nip parts, the toners in portions where the voltage involved in the discharge is applied are attracted from the intermediate transfer belt 6 to the photoconductors 1. As a result, the portions of the toner images on the intermediate transfer belt 6 may adhere to the photoconductors 1, and this is called the retransfer phenomenon.

Furthermore, if there is an unpassed first transfer nip part in downstream of the conveyance direction of the intermediate transfer belt 6, the toner image retransfer phenomenon may occur at this unpassed first transfer nip part.

Note that the graph illustrated in FIG. 2 is only exemplary, and voltages for starting discharge in the form of streaks and dots change depending on the material and size, for example, of members related to first transfer.

Figure 3:
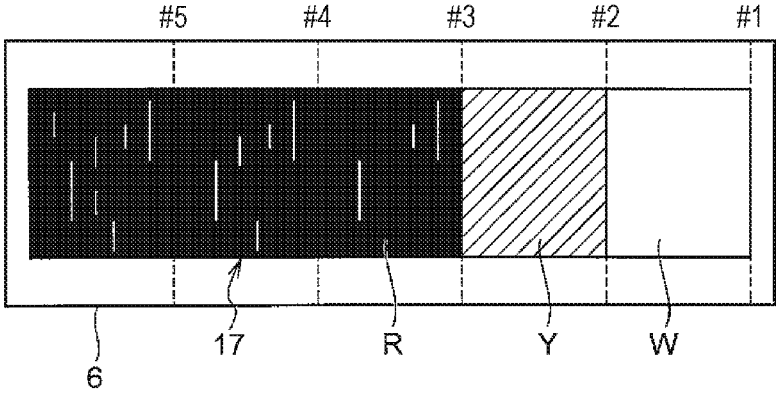
FIG. 3 is a schematic diagram for describing defects caused by a toner image retransfer phenomenon.

FIG. 3 is a diagram that schematically illustrates the situation where the defects 17 are caused by the toner image retransfer phenomenon. Here, "#1" represents a first transfer nip part for W; "#2" represents a first transfer nip part for Y; "#3" represents a first transfer nip part for M; "#4" represents a first transfer nip part for C; and "#5" represents a first transfer nip part for K. A W toner image is transferred at #1, a Y toner image is transferred at #2, and a M toner image is transferred at #3 to the intermediate transfer belt 6 in this order, thereby forming a R toner image on a W undercoat. Note that no toner images are transferred at the first transfer nip parts #4 and #5.

As illustrated in FIG. 3, at points at which the W and Y toner images are transferred at the first transfer nip parts #1 and #2 to the intermediate transfer belt 6, since there is only a toner amount corresponding to the toner images of the two colors, the system resistance at each of the first transfer nip parts has not risen to a system resistance corresponding to a voltage for starting discharge. However, when the M toner image is transferred at the first transfer nip part #3 to the intermediate transfer belt 6, the toner images having a toner amount corresponding to the three colors W, Y, and M are transferred to the intermediate transfer belt 6, and the system resistance at the first transfer nip part #3 has conceivably risen to a system resistance corresponding to a voltage for starting discharge. Therefore, discharge occurs at the first transfer nip part #3, and the defects 17 illustrated in FIG. 3 appear in the toner images.

Taking the order of transferring the toner images in consideration, a toner image transferred at last is superimposed on the uppermost layer viewed from the intermediate transfer belt 6. Among the W, Y, and M toner images, the M toner image, positioned at the uppermost layer, is most vulnerable to the influence of discharge. Therefore, the retransfer phenomenon occurs mainly in the M toner image, and accordingly the defects 17 where the fading of the toner M occurs appear. In this case, the color of the defects 17 is Y since there is the Y toner image in a lower layer adjacent to the M toner image.

Though the toner images are not transferred at the first transfer nip parts #4 and #5, because first transfer bias is applied to the first transfer nip parts #4 and #5, discharge occurs at the first transfer nip parts #4 and #5 whenever the toner images on the intermediate transfer belt 6 pass the first transfer nip parts #4 and #5, and accordingly the number of defects 17 increases, as illustrated in FIG. 3.

Note that the defects 17 occurring in the toner images differ in visibility depending on the combination of colors of the toner images to be transferred and the order of transferring these toner images.

FIGS. 4A to 4D are diagrams illustrating the state in the case where the toner images on the intermediate transfer belt 6, where the defects 17 have occurred, are second-transferred to the film P.

Figure 4A:
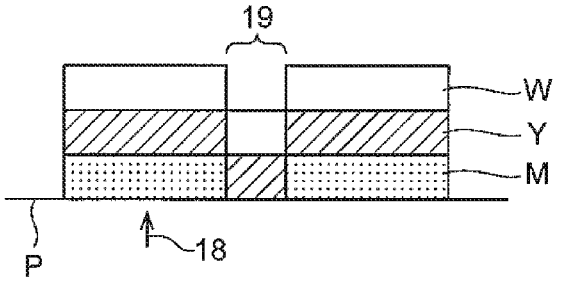
FIGS. 4A to 4D are diagrams illustrating exemplary situations in the case where a toner image with defects is transferred to a film.

Among these diagrams, FIG. 4A illustrates the state where the toner images are stacked on the film P in the order M, Y, and W from the bottom. An area 19 is a portion where the defects 17 have occurred. In the area 19 illustrated in FIG. 4A, the color of the M toner image has faded due to the retransfer phenomenon. Thus, the Y and W toner images are shifted by one layer, and are transferred to the film P.

Referring to FIG. 4A, when the film P is viewed from the direction indicated by arrow 18, the combination of the Y and M toner images causes a R user image to be displayed, whereas the defects 17 in Y are displayed in the area 19. In this case, as illustrated in FIG. 5, the color difference between R and Y is 100 or greater, and the brightness difference thereof is 40 or greater. A combination of colors whose color difference is about 100 or greater and brightness difference is about 40 or greater tends to be a combination of colors whose difference is easily recognized, though this may be different from individual to individual. Therefore, in the case of FIG. 4A, the visibility of the defects 17 in the area 19 becomes higher, resulting in degradation of the image quality.

Figure 4B:
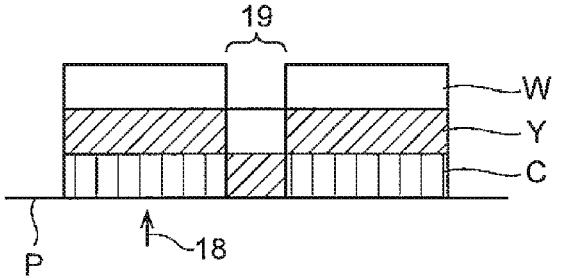

FIG. 4B illustrates the state where the toner images are stacked on the film P in the order C, Y, and W from the bottom. In the area 19 illustrated in FIG. 4B, the color of the C toner image has faded due to the retransfer phenomenon. Thus, the Y and W toner images are shifted by one layer, and are transferred to the film P.

Referring to FIG. 4B, when the film P is viewed from the direction indicated by arrow 18, the combination of the C and Y toner images causes a green (G) user image to be displayed, whereas the defects 17 in Y are displayed in the area 19. In this case, as illustrated in FIG. 5, the color difference between G and Y is 100 or greater, and the brightness difference thereof is 40 or greater. Therefore, like the case of FIG. 4A, the visibility of the defects 17 in the area 19 becomes higher, resulting in degradation of the image quality.

Figure 4C:
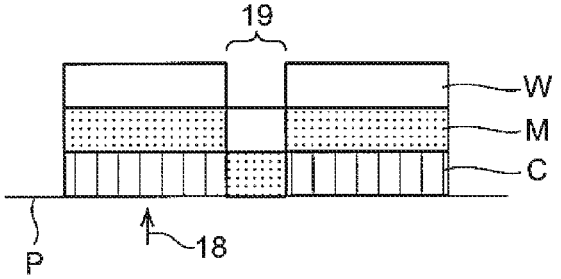

In contrast, FIG. 4C illustrates the state where the toner images are stacked on the film P in the order C, M, and W from the bottom. In the area 19 illustrated in FIG. 4C, the color of the C toner image has faded due to the retransfer phenomenon. Thus, the M and W toner images are shifted by one layer, and are transferred to the film P.

Referring to FIG. 4C, when the film P is viewed from the direction indicated by arrow 18, the combination of the C and M toner images causes a blue (B) user image to be displayed, whereas the defects 17 in M are displayed in the area 19. In this case, as illustrated in FIG. 5, the color difference between B and M is less than 100, and the brightness difference thereof is less than 40. Therefore, compared with the case of FIG. 4A and the case of FIG. 4B, the visibility of the defects 17 in the area 19 becomes lower, and degradation of the image quality becomes less likely to occur.

Figure 4D:
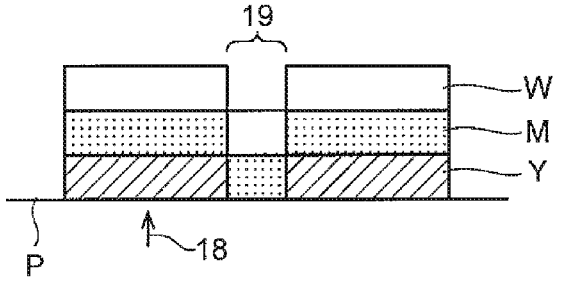

FIG. 4D illustrates the state where the toner images are stacked on the film P in the order Y, M, and W from the bottom. This corresponds to the case where the order of transferring the Y and M toner images, illustrated in FIG. 4A, is reversed. In the area 19 illustrated in FIG. 4D, the color of the Y toner image has faded due to the retransfer phenomenon. Thus, the M and W toner images are shifted by one layer, and are transferred to the film P.

Referring to FIG. 4D, when the film P is viewed from the direction indicated by arrow 18, the combination of the Y and M toner images causes a R user image to be displayed, whereas the defects 17 in M are displayed in the area 19. In this case, as illustrated in FIG. 5, the color difference between R and M is less than 100, and the brightness difference thereof is less than 40. Therefore, compared with the case of FIG. 4A and the case of FIG. 4B, the visibility of the defects 17 in the area 19 becomes lower, and degradation of the image quality becomes less likely to occur.

Referring to FIG. 5, Bk represents the black color generated by Y, M, and C. For example, when the defects 17 in M appear in a Bk user image after the color Y has faded, the color difference between Bk and M is less than 100, and the brightness difference thereof is less than 40. Therefore, compared with the case of FIG. 4A and the case of FIG. 4B, the visibility of the defects 17 in the area 19 becomes lower, and degradation of the image quality becomes less likely to occur.

That is, the visibility of the defects 17 changes depending on the combination of the colors of the user image and the colors in the color-faded portions, or the order of transferring the toner images. However, since the colors of the user image are colors specified by the user, it is difficult to adjust the colors of the user image on the image forming apparatus 20 so as to lower the visibility of portions including the defects 17.

Since the order of arranging the image forming units 15 is also predetermined and incorporated in the image forming apparatus 20, at the time of image formation, it is difficult to change the order of transferring the toner images by changing the order of arranging the image forming units 15 so as to lower the visibility of portions including the defects 17. Furthermore, as illustrated in FIG. 4D, when the R user image is formed by reversing the order of transferring the Y and M toner images in FIG. 4A to lower the visibility of the defects 17 in the area 19, if the second transfer device 7 performs second transfer of the toner images on the intermediate transfer belt 6 to the film P, the M toner image is positioned in an upper layer than the Y toner image on the film P, and accordingly, the M toner image tends to remain on the intermediate transfer belt 6 than the Y toner image. When the M toner image remains on the intermediate transfer belt 6, because M has a lower brightness than Y, degradation of the image quality becomes more noticeable, compared with the case where the Y toner image remains on the intermediate transfer belt 6.

Therefore, the method of changing the order of transferring the toner images is not suitable as a method for lowering the visibility of the defects 17.

To this end, the method of suppressing discharge that occurs at the first transfer nip parts and reducing the defects 17 in the toner images will be examined.

To suppress discharge at the first transfer nip parts, the voltage of first transfer bias applied to the first transfer nip parts is simply set to be lower than a voltage at which discharge starts to occur. Since constant current control is executed by the first transfer bias power supply, the voltage of first transfer bias is simply lowered by lowering the system resistance on a circuit to which the first transfer bias is applied. To do so, as has been described with reference to FIG. 1, the toner amount of toner images to be transferred to the intermediate transfer belt 6 is simply reduced.

Figure 6:
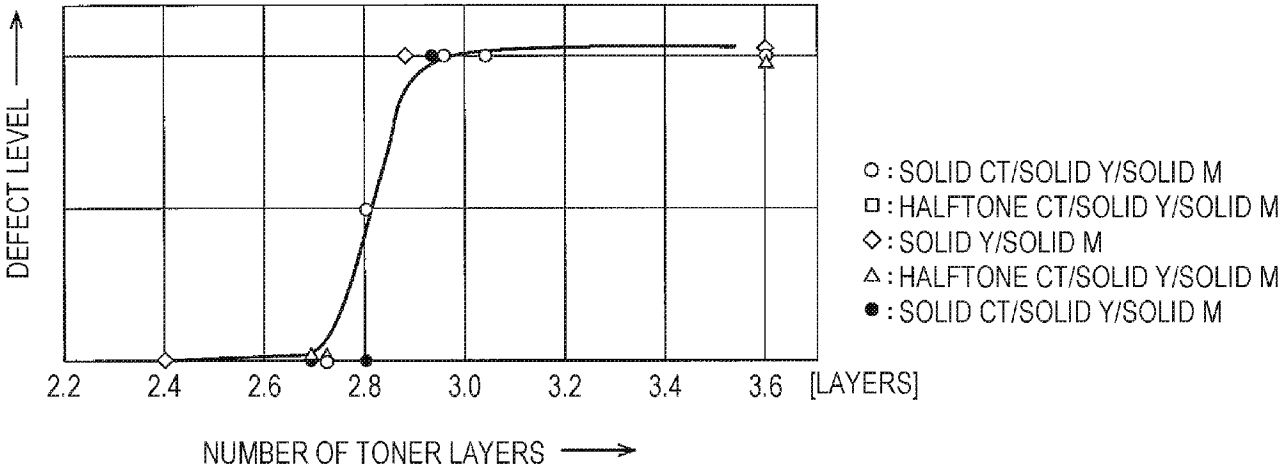
FIG. 6 is a diagram illustrating exemplary changes in a defect level with respect to the number of toner layers.

FIG. 6 is a diagram illustrating the degree of the defects 17 occurring in the toner images, that is, the defect level, when the number of toner layers of the toner images formed by Y, M, and CT is changed. In FIG. 6, a solidly-filled image is referred to as "solid", and a halftone image where toners have faded in some places is referred to as "halftone". The defect level takes a value from 1 to 3 (inclusive), for example. The greater the value of the defect level, the more the defects 17 occurring in a toner image.

Here, the number of toner layers is an index that represents a toner amount represented by a toner weight per unit area. Toners are such that the weight of one particle is different from one toner color to another. It is thus difficult to represent, using the toner weight alone, a specific range of densities of toner images adhering to the intermediate transfer belt 6. Thus, a toner filling the entirety of a unit area serves as a density of 100%, and a toner weight in this case is determined in advance for each toner color. The number of toner layers in this state serves as about 1.0 layer to about 1.2 layers. The reason the number of toner layers in the case where the density is 100% is a value around about 1.1 layers is that, when the number of toner layers in a state where a unit area is filled with toner particles one by one in the height direction is 1 layer, there may be a gap between toners depending on the situation, and the result may seem to be toner images whose density is less than 100%. Therefore, a toner amount that is 1 layer or greater may sometimes be necessary for forming toner images with a density of 100%. The number of toner layers in the case where the density is 100% is thus set as a value around about 1.1 layers to provide some allowance.

As illustrated in FIG. 6, when toner images with about 2.4 layers are formed on the intermediate transfer belt 6 by having, for example, both the Y and M toner images as solid images and not transferring the CT toner image, the defect level becomes 1, which means that the defects 17 are not noticeable.

However, while the Y and M toner images are both solid images, if the density of the CT toner image is gradually increased and the number of layers of the toner images formed by the Y, M, and CT toners on the intermediate transfer belt 6 reaches about 2.7 layers, the defect level starts to rise. When the number of layers of the toner images becomes about 2.8 layers, the defect level becomes 2, which means that the defects 17 start to be noticeable.

Furthermore, when the number of layers of the toner images formed by the Y, M, and CT toners on the intermediate transfer belt 6 becomes about 3 or more layers by increasing the density of the CT toner image, the defect level becomes 3, which means that the occurrence of the defects 17 becomes conspicuous.

FIG. 7 is a diagram that organizes an exemplary relationship between the number of toner layers and the defect level, illustrated in FIG. 6, in the form of a table. FIGS. 6 and 7 show that the defect level becomes 1 when the number of toner layers is about 2.7 or less; the defect level becomes 2 when the number of toner layers becomes about 2.8; and the defect level becomes 3 when the number of layers becomes about 3 or greater.

That is, the frequency of occurrence of the defects 17 in the YMCK and CT toner images transferred to the intermediate transfer belt 6 may be lowered by reducing the toner amount of these toner images.

However, like the image forming apparatus 20 according to the exemplary embodiment, in the case of the image forming apparatus 20 which uses the W toner as the spot color CT, the W toner is mainly used for the undercoat of toner images formed by the YMCK colored toners. That is, if the toner amount of the W toner image is reduced to be less than a toner amount (predetermined amount) determined in advance for each toner color in accordance with the density of a toner image to form, for example the density of W becomes lower in an area covered with the undercoat. Since the masking property of the undercoat becomes lower, the quality of the entire user image may be degraded. Therefore, it is preferable not to reduce the amount of the W toner to be less than the predetermined amount, but to maintain the predetermined amount.

Although the reason that it is preferable not to reduce the amount of the W toner to be less than the predetermined amount has been described as above, the details thereof similarly apply to other spot color toners other than W. Specifically, a gold or silver toner is used for applications such as making the user image glossy. If the toner amount of gold or silver is reduced to be less than its predetermined amount, the glossiness of the user image may be lowered, and accordingly the quality of the entire user image may be degraded. In addition, a transparent color toner is used for applications such as coating the user image. If the toner amount of such a transparent color is reduced to be less than its predetermined amount, the being-coated quality of the user image may be lowered, and accordingly the quality of the entire user image may be degraded.

In contrast, the YMCK colored toners are used to represent colors included in a color gamut which is a color representation range. When the film P is used as a recording medium as in the image forming apparatus 20, toner is less likely to soak into the film P, compared with paper. Even when the amount of each of the colored toners is reduced to be less than its predetermined amount, it is less likely that a color gamut realized by a combination of the colored toners becomes narrower.

Figure 8:
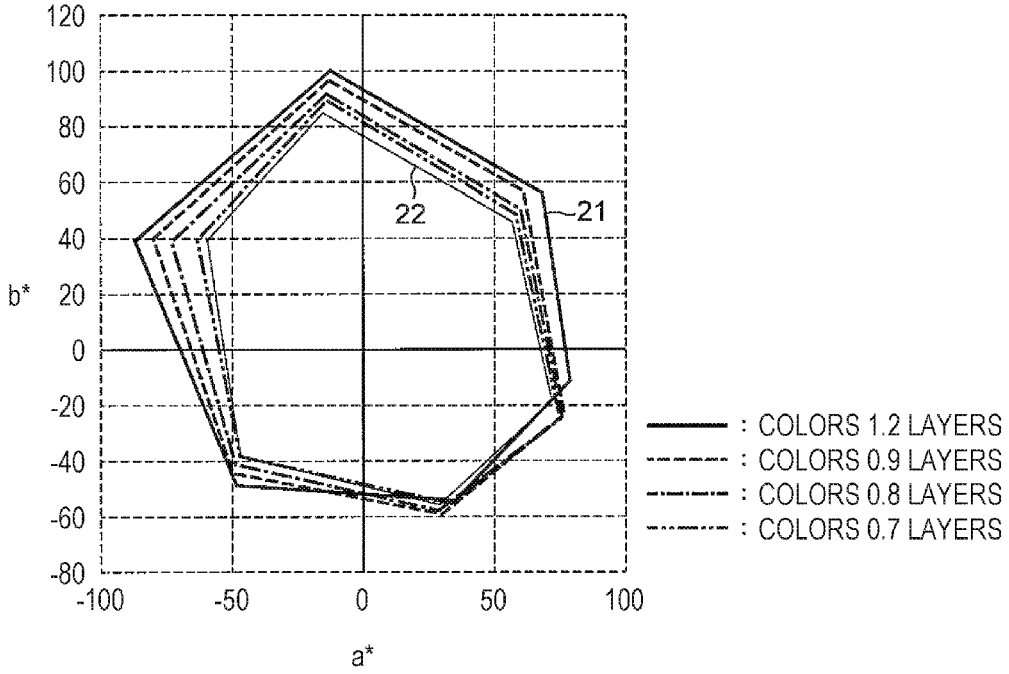
FIG. 8 is a diagram illustrating exemplary changes in a color gamut with respect to the number of toner layers.

FIG. 8 is a diagram illustrating an exemplary color gamut in the case where the number of toner layers of the colored toners is changed from 0.7 layer to 1.2 layers. FIG. 8 is a chromaticity diagram in the L*a*b* color system. An area surrounded by a polygon associated with each number of toner layers serves as a color gamut in the case of using the colored toners having that number of toner layers.

Referring to FIG. 8, when a color gamut 21 in the case where the number of toner layers of the colored toners is 1.2 layers is compared with a color gamut 22 in the case where the number of toner layers of the colored toners is 0.7 layer, the color gamut 22 is narrower than the color gamut 21. However, although the number of toner layers is reduced by about 40% from 1.2 layers to 0.7 layer, the reduction rate of the color gamut is smaller than the reduction rate of the number of toner layers, and the color gamut 21 may be regarded as a color gamut substantially equivalent to the color gamut 22. That is, quality degradation of the user image caused by reduction in the number of toner layers of the colored toners is suppressed within a range where there are no problems in practical applications.

Here, the following mode is discussed. That is, the order of forming the toner images in the image forming apparatus 20 illustrated in FIG. 1 is changed to, for example, the order Y, M, C, K, and W, and the spot color toner is transferred to the intermediate transfer belt 6 after the colored toners are transferred. An image forming apparatus with such an order of transferring the toner images is such that the W toner image, serving as the undercoat, is arranged at the uppermost layer of the toner images transferred to the intermediate transfer belt 6. When the film P is used as a recording medium, the W toner image becomes an obstacle from the side opposite to the image forming side of the film P, and accordingly a user image formed by the colored toners is not recognizable.

For a recording medium of an image forming apparatus that transfers the spot color toner after transferring the colored toners to the intermediate transfer belt 6, a recording medium used in such a manner that a user image is viewable from the image forming side, such as paper, is used, instead of the film P. Hereinafter, such an image forming apparatus whose order of transferring the toner images is opposite from that of the image forming apparatus 20 will be referred to as an "image forming apparatus dedicated to paper".

In an image forming apparatus dedicated to paper, what is most vulnerable to the influence of discharge at the first transfer nip parts is the W toner image positioned at the uppermost layer. Since a user image formed by the colored toners is stacked on the undercoat of W on paper, even if the toner images, each having a toner amount in accordance with its predetermined amount for a corresponding one of the colored toners and the W toner, are transferred to the intermediate transfer belt 6, the quality of the user image is less likely to be degraded, compared with the image forming apparatus 20.

Yet furthermore, since the surface of paper is uneven compared with the film P, if the toner amount of each of the colored toners and the spot color toner is reduced to be less than its predetermined amount in the image forming apparatus dedicated to paper, the toners soak into recessed portions of the paper, while the toners do not adhere to protruding portions of the paper, which may result in degradation of the quality of the user image.

Since color paper colored with a color other than white is sometimes used as a recording medium in the image forming apparatus dedicated to paper, to prevent the color of the color paper from mixing with the colors of the user image, it is preferable to form the undercoat of W between the color paper and the user image in order to prevent the color of the color paper from penetrating through the user image.

Therefore, it is preferable in the image forming apparatus dedicated to paper to transfer the toner images, each with an amount of the colored toners and the spot color toner in accordance with its predetermined amount, to the intermediate transfer belt 6. In other words, the predetermined amount of toner is the toner amount determined in advance for each toner color in accordance with the density of each toner image to form using the image forming apparatus dedicated to paper. This predetermined amount is obtained in advance by an experiment conducted by the actual image forming apparatus dedicated to paper, or a computer simulation based on the design specifications of the image forming apparatus dedicated to paper.

Figure 9:
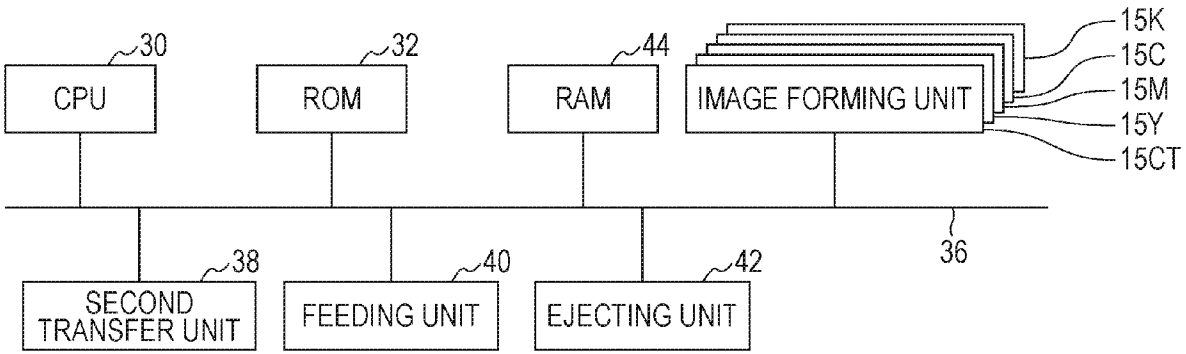
FIG. 9 is a diagram illustrating an exemplary configuration of main portions of the electrical system of the image forming apparatus.

Referring next to FIG. 9, the configuration of main portions of the electrical system of the image forming apparatus 20 according to the exemplary embodiment will be described.

As illustrated in FIG. 9, the image forming apparatus 20 according to the exemplary embodiment includes a central processing unit (CPU) 30, which applies control to reduce the amounts of colored toners included in toner images transferred to the intermediate transfer belt 6 to be less than their predetermined amounts. The image forming apparatus 20 further includes a read-only memory (ROM) 32 where various programs and various parameters are stored in advance, and a random-access memory (RAM) 44 used as a work area for the CPU 30 when executing various programs.

The CPU 30, the ROM 32, and the RAM 44 are connected to one another by a bus 36 of the image forming apparatus 20. A second transfer unit 38, a feeding unit 40, and an ejecting unit 42 are further connected to the bus 36. Note that the second transfer unit 38 includes the second transfer device 7, or a member related to second transfer to the film P, such as a motor (not illustrated) for driving the backup roll 7A included in the second transfer device 7. The feeding unit 40 includes the film conveying roller 13, and a member related to feeding of the film P, such as a motor (not illustrated) for driving the film conveying roller 13. The ejecting unit 42 includes the fixing unit 9, or a member related to ejection of the film P.

Figure 10:
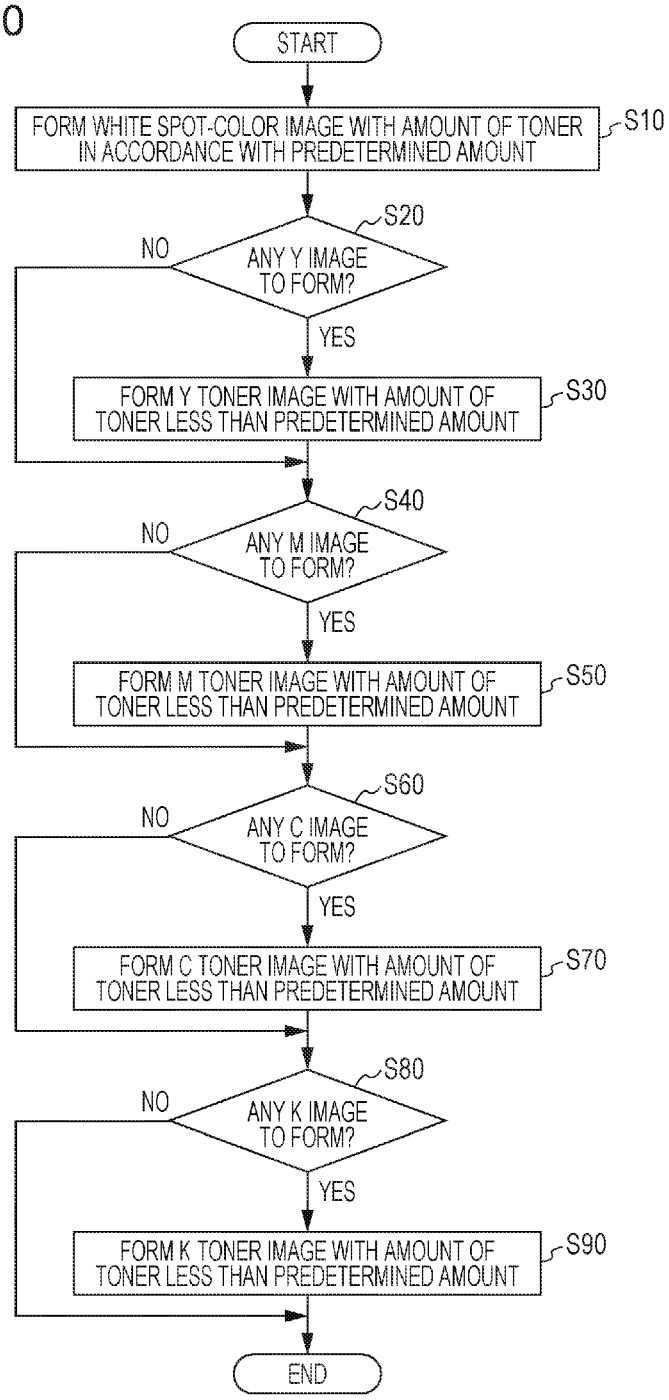
FIG. 10 is a flowchart illustrating an exemplary flow of an image forming process.

Referring next to FIG. 10, the operation of the image forming apparatus 20 will be described. FIG. 10 is a flowchart illustrating an exemplary flow of an image forming process in accordance with an image forming program executed by the CPU 30 when the CPU 30 receives a user image serving as an image forming target.

Note that the image forming program is stored in advance in the ROM 32. It is also assumed that, for each toner color used in the image forming apparatus dedicated to paper, a predetermined amount is stored in a predetermined area of the ROM 32.

In step S10, the CPU 30 controls the image forming unit 15CT to form an electrostatic latent image corresponding to the received user image on the photoconductor 1CT. The CPU 30 reads, from the ROM 32, the predetermined amount of the W toner in accordance with the density of W necessary for the user image.

The CPU 30 controls the amount of the W toner supplied from the developer 4CT to the developing roller 34CT in order that the amount of the W toner supplied to the developing roller 34CT becomes the predetermined amount read from the ROM 32 in this step, thereby developing the electrostatic latent image using the amount of toner in accordance with the predetermined amount. The CPU 30 controls the first transfer device 5CT to transfer the W toner image having the amount of toner in accordance with the predetermined amount to the intermediate transfer belt 6.

In step S20, the CPU 30 determines whether it is necessary to form a Y toner image, on the basis of image information of the individual colors of the received user image. When the determination is negative, the CPU 30 omits the processing in later-described step S30, and proceeds to step S40. In contrast, when the determination is affirmative, the CPU 30 proceeds to step S30.

In step S30, the CPU 30 controls the image forming unit 15Y to form an electrostatic latent image corresponding to the received user image on the photoconductor 1Y. The CPU 30 reads, from the ROM 32, the predetermined amount of the Y toner in accordance with the density of Y necessary for the user image.

The CPU 30 controls the amount of the Y toner supplied from the developer 4Y to the developing roller 34Y in order that the amount of the Y toner supplied to the developing roller 34Y becomes less than the predetermined amount read from the ROM 32 in this step, thereby developing the electrostatic latent image using the amount of toner less than the predetermined amount. The CPU 30 controls the first transfer device 5Y to transfer the Y toner image having the amount of toner less than the predetermined amount to the intermediate transfer belt 6.

In step S40, the CPU 30 determines whether it is necessary to form a M toner image, on the basis of image information of the individual colors of the received user image. When the determination is negative, the CPU 30 omits the processing in later-described step S50, and proceeds to step S60. In contrast, when the determination is affirmative, the CPU 30 proceeds to step S50.

In step S50, the CPU 30 controls the image forming unit 15M to form an electrostatic latent image corresponding to the received user image on the photoconductor 1M. The CPU 30 reads, from the ROM 32, the predetermined amount of the M toner in accordance with the density of M necessary for the user image.

The CPU 30 controls the amount of the M toner supplied from the developer 4M to the developing roller 34M in order that the amount of the M toner supplied to the developing roller 34M becomes less than the predetermined amount read from the ROM 32 in this step, thereby developing the electrostatic latent image using the amount of toner less than the predetermined amount. The CPU 30 controls the first transfer device 5M to transfer the M toner image having the amount of toner less than the predetermined amount to the intermediate transfer belt 6.

In step S60, the CPU 30 determines whether it is necessary to form a C toner image, on the basis of image information of the individual colors of the received user image. When the determination is negative, the CPU 30 omits the processing in later-described step S70, and proceeds to step S80. In contrast, when the determination is affirmative, the CPU 30 proceeds to step S70.

In step S70, the CPU 30 controls the image forming unit 15C to form an electrostatic latent image corresponding to the received user image on the photoconductor 1C. The CPU 30 reads, from the ROM 32, the predetermined amount of the C toner in accordance with the density of C necessary for the user image.

The CPU 30 controls the amount of the C toner supplied from the developer 4C to the developing roller 34C in order that the amount of the C toner supplied to the developing roller 34C becomes less than the predetermined amount read from the ROM 32 in this step, thereby developing the electrostatic latent image using the amount of toner less than the predetermined amount. The CPU 30 controls the first transfer device 5C to transfer the C toner image having the amount of toner less than the predetermined amount to the intermediate transfer belt 6.

In step S80, the CPU 30 determines whether it is necessary to form a K toner image, on the basis of image information of the individual colors of the received user image. When the determination is negative, the CPU 30 omits the processing in later-described step S90, and ends the image forming process illustrated in FIG. 10. In contrast, when the determination is affirmative, the CPU 30 proceeds to step S90.

In step S90, the CPU 30 controls the image forming unit 15K to form an electrostatic latent image corresponding to the received user image on the photoconductor 1K. The CPU 30 reads, from the ROM 32, the predetermined amount of the K toner in accordance with the density of K necessary for the user image.

The CPU 30 controls the amount of the K toner supplied from the developer 4K to the developing roller 34K in order that the amount of the K toner supplied to the developing roller 34K becomes less than the predetermined amount read from the ROM 32 in this step, thereby developing the electrostatic latent image using the amount of toner less than the predetermined amount. The CPU 30 controls the first transfer device 5K to transfer the K toner image having the amount of toner less than the predetermined amount to the intermediate transfer belt 6, and ends the image forming process illustrated in FIG. 10.

Thereafter, the CPU 30 transfers the toner images, transferred to the intermediate transfer belt 6, to the film P by using the second transfer device 7, and ejects the film P which has gone through the fixing unit 9.

Note that there are no particular restrictions on the amount of reduction in the predetermined amount of each of the YMCK colored toners. It is preferable that the sum of toner layers of the YMCK colored toners and the spot color W toner be about 2.7 layers or less at which the defect level starts to rise.

Although toner images of the colored toners whose amounts are less than their predetermined amounts are formed by controlling the amounts of the colored toners supplied from the developers 4 to the developing rollers 34 in steps S30, S50, S70, and S90, the method of controlling the toner amounts of the toner images is not limited to that described above. For example, the output of each laser output 3 which forms an electrostatic latent image on a corresponding photoconductor 1 may be adjusted to reduce the amount of a corresponding colored toner adhering to the electrostatic latent image to be less than the predetermined amount.

Although the electrostatic latent images are developed with the amounts of toners less than the predetermined amounts read from the ROM 32 in steps S30, S50, S70, and S90, needless to say, a table defining, for each colored toner, a toner amount less than the predetermined amount may be stored in advance in the ROM 32, and the electrostatic latent images may be developed in accordance with each toner amount defined in this table.

Next, the results of a sensory analysis conducted on the image quality when a user image is formed on the film P using the image forming apparatus 20 and the image forming apparatus dedicated to paper which execute the image forming process illustrated in FIG. 10 will be discussed.

At first, the environment of the sensory analysis will be discussed. In a place where the sensory analysis is conducted, the temperature is 10° C., and the humidity is 15%. The processing speed of each image forming apparatus to be evaluated is 524 mm/s. The first transfer devices 5 are elastic rolls, each with a hardness of ASKER Durometer Type C 30°, a diameter of 28 mm, and a resistance value of 7.7 log/Ω. As the intermediate transfer belt 6, an endless belt composed of polyimide with carbon blended therein is used, and this endless belt has a volume resistivity of 12.5 log Ωcm. In addition, the backup roll 7A configuring the second transfer device 7 is an elastic roll with a surface resistivity of 7.3 log Ω/, a hardness of ASKER Durometer Type C 53°, and a diameter of 28 mm. The second transfer roll 7B is an elastic roll which has a resistance value of 6.3 log Ω and a diameter of 28 mm. The first transfer bias power supply performs constant current control so that the current flowing during first transfer becomes 54 μA. Also, the average toner particle size of the W toner used is 5.8 μm, the average toner particle size of each of the YMCK toners is 4.7 μm, and the thickness of the film P is 100 μm.

A user image to be formed on the film P is an image obtained by superimposing YMW solid images. The image forming apparatus 20 forms an evaluation image F1 in which the number of toner layers of W is 1.2 layers, and the number of toner layers of each of Y and M is 0.7 layers, and an evaluation image F2 in which the number of toner layers of W is 1.2 layers, and the number of toner layers of each of Y and M is 1.0 layer. In contrast, for comparison with the evaluation image F2, the image forming apparatus dedicated to paper forms an evaluation image F3 in which the number of toner layers of W is 1.2 layers, and the number of toner layers of each of Y and M is 1.0 layer in accordance with the evaluation image F2.

As a result of a sensory analysis conducted on the image quality of the evaluation images F1 to F3, no striking defects 17 are observed in the evaluation images F1 and F3, and the defect level in these images F1 and F3 is 1. In contrast, fading of M and defects 17 in the form of streaks are observed in the evaluation image F2 where the total number of toner layers of the toners is greater than or equal to 3.0.

In the case of the image forming apparatus 20, the user image is observed from the side opposite to the image forming side of the film P to evaluate the image quality, whereas, in the case of the image forming apparatus dedicated to paper, the user image is observed from the image forming side of the film P to evaluate the image quality.

As has been described above, the image forming apparatus 20 according to the exemplary embodiment forms toner images on the intermediate transfer belt 6 in the order of a toner image of the spot color toner and then toner images of the colored toners. Since the number of toner layers of each of the colored toners is less than the number of toner layers indicated by a predetermined amount, the first transfer voltage applied to the first transfer nip parts becomes lower, and discharge occurring at the first transfer nip parts is suppressed. Accordingly, the defects 17 occurring in the toner images become fewer, thereby suppressing degradation of the quality of the user image.

The mode of transferring the toner images while reducing the number of toner layers of the colored toners to be less than the number of toner layers indicated by the predetermined amount is applicable to, in addition to the image forming apparatus 20 using the intermediate transfer belt 6, a direct-transfer-type image forming apparatus that directly superimposes the colored toners and the spot color toner on paper while conveying the paper.

Although the exemplary embodiment of the present invention has been described as above, the present invention is not limited to the range described in the exemplary embodiment. Various changes or modifications may be added to the exemplary embodiment without departing from the gist of the present invention. An embodiment to which the changes or modifications are added is also included in the technical scope of the present invention. For example, the order of processes may be changed without departing from the gist of the present invention.

Although the mode where the image forming process performed by the controller 60 is realized by software has been described by way of example in the exemplary embodiment, a process equivalent to the flowchart illustrated in FIG. 10 may be processed by hardware. In this case, the process may be speeded up, compared with the case where the process performed by the controller 60 is realized by software.

Although the mode where the image forming program is installed in the ROM 32 has been described in the exemplary embodiment, the mode is not limited to that described above. The image forming program according to the exemplary embodiment may be recorded in a computer readable recording medium and may be provided. For example, the image forming program according to the exemplary embodiment of the present invention may be recorded in a portable recording medium such as a compact disc (CD)-ROM, a digital versatile disc (DVD)-ROM, or a universal serial bus (USB) memory, and may be provided. Alternatively, the image forming program according to the exemplary embodiment of the present invention may be recorded in a semiconductor memory such as a flash memory and may be provided.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of first image forming units that transfer toner images developed with colored toners to a transfer body, and form first images on the transfer body;

a second image forming unit that transfers a toner image developed with a spot color toner different from colors of the colored toners to the transfer body prior to the plurality of first image forming units, and forms a second image serving as an undercoat or an overcoat of the first images on the transfer body; and a controller that controls the plurality of first image forming units in order that amounts of the colored toners used for forming the first images by the plurality of first image forming units become less than amounts of the colored toners used when the first images are formed prior to the second image.

2. The image forming apparatus according to claim 1, wherein a color of the spot color toner is white.

3. The image forming apparatus according to claim 1, wherein the controller controls the second image forming unit to form the second image on the transfer body using an amount of the spot color toner, the amount being associated in advance with a density of the second image.

4. The image forming apparatus according to claim 2, wherein the controller controls the second image forming unit to form the second image on the transfer body using an amount of the spot color toner, the amount being associated in advance with a density of the second image.

5. The image forming apparatus according to claim 1, wherein the transfer body is an intermediate transfer body, and the image forming apparatus further comprises a transfer unit that transfers the first images and the second image formed on the intermediate transfer body to a transparent sheet.

6. The image forming apparatus according to claim 2, wherein the transfer body is an intermediate transfer body, and the image forming apparatus further comprises a transfer unit that transfers the first images and the second image formed on the intermediate transfer body to a transparent sheet.

7. The image forming apparatus according to claim 3, wherein the transfer body is an intermediate transfer body, and the image forming apparatus further comprises a transfer unit that transfers the first images and the second image formed on the intermediate transfer body to a transparent sheet.

8. The image forming apparatus according to claim 4, wherein the transfer body is an intermediate transfer body, and the image forming apparatus further comprises a transfer unit that transfers the first images and the second image formed on the intermediate transfer body to a transparent sheet.

9. An image forming method comprising:

transferring toner images developed with colored toners to a transfer body, and forming first images on the transfer body;

transferring a toner image developed with a spot color toner different from colors of the colored toners to the transfer body prior to transferring the toner images developed with the colored toners, and forming a second image serving as an undercoat or an overcoat of the first images on the transfer body; and applying control in order that amounts of the colored toners used for forming the first images become less than amounts of the colored toners used when the first images are formed prior to the second image.

10. A non-transitory computer readable medium storing a program causing a computer to execute the method of claim 9.

* * * * *